US007224338B2

(12) United States Patent
Yamada

(10) Patent No.: US 7,224,338 B2
(45) Date of Patent: May 29, 2007

(54) SIGNAL PROCESSING CIRCUIT AND LIQUID CRYSTAL DISPLAY DEVICE USING THE SAME

(75) Inventor: Yukimitsu Yamada, Miyagi-ken (JP)

(73) Assignee: Alps Electric Co., Ltd., Ota-Ku, Tokyo (JP)

( * ) Notice: Subject to any disclaimer, the term of this patent is extended or adjusted under 35 U.S.C. 154(b) by 633 days.

(21) Appl. No.: 10/792,077

(22) Filed: Mar. 2, 2004

(65) Prior Publication Data

US 2004/0174329 A1 Sep. 9, 2004

(30) Foreign Application Priority Data

Mar. 7, 2003 (JP) ..... 2003-061568

(51) Int. Cl.
*G09G 3/36* (2006.01)

(52) U.S. Cl. ..... 345/89; 345/204

(58) Field of Classification Search ..... 345/87–100, 345/204

See application file for complete search history.

(56) References Cited

U.S. PATENT DOCUMENTS 6,184,855 B1 2/2001 Kobayashi et al.

6,693,614 B2 * 2/2004 Kamiya et al. ..... 345/89

FOREIGN PATENT DOCUMENTS

JP 2001-188499 7/2001

* cited by examiner

*Primary Examiner*—Richard Hjerpe
*Assistant Examiner*—Jean Lesperance
(74) *Attorney, Agent, or Firm*—Beyer Weaver LLP

(57) ABSTRACT

A signal processing circuit includes a digital-to-analog (D/A) conversion circuit having a D/A converter and a buffer for converting input digital grayscale data into an analog voltage and outputting the converted analog voltage, a first switch that changes its output mode so that a supplied voltage is output as a supply analog voltage, a second switch that outputs any of the converted analog voltage and the supply analog voltage as an analog voltage, and a detection circuit. The detection circuit determines whether or not the input digital grayscale data matches internal set data. When it is determined that the input digital grayscale data matches the set data, the detection circuit switches the first switch so that the supply analog voltage corresponding to the digital grayscale data is output, and also switches the second switch so that the supply analog voltage is output.

12 Claims, 4 Drawing Sheets

SIGNAL PROCESSING CIRCUIT AND LIQUID CRYSTAL DISPLAY DEVICE USING THE SAME

BACKGROUND OF THE INVENTION

1. Field of the Invention

The present invention relates to a signal processing circuit, and particularly to a circuit that drives a liquid crystal device in a liquid crystal display device.

2. Description of the Related Art

As shown in FIG. 4, a liquid crystal driving circuit is formed comprising a digital circuit and an analog circuit.

The digital circuit includes a shift register 101 to which data is input column-by-column, data registers 102 that receive data to be displayed from the shift register 101 and that temporarily store the received data, and data latches 103 that hold the data which is being displayed.

The analog circuit includes D/A (digital-to-analog) converters 104 that convert digital data to analog data based on a predetermined relationship, and buffers 105 for power amplification of the converted analog data to drive liquid crystal devices.

A liquid crystal display device has the structure shown in FIG. 5, including a source driver 200 that outputs and supplies display data to a liquid crystal device 203 connected with each column line, and a gate driver 201 that outputs a control signal to a gate of a transistor connected with a desired row line and that supplies the display data to the liquid crystal devices corresponding to the row line to be displayed and thereby writing the display data to the predetermined liquid crystal devices. Due to their low-power-consumption, liquid crystal display devices have recently seen increased usage in portable devices such as cellular phones. In order to support smaller portable devices, the demands for liquid crystal display devices having even lower power consumption have increased.

In the conventional liquid crystal driving circuit such as shown in FIG. 4, the power consumption of the analog circuit is higher than the digital circuit. In particular, the power consumption required for digital-to-analog conversion of the D/A converters 104 and power amplification of the buffers 105 to drive the liquid crystal devices occupies 70% to 80% of the overall power consumption of the liquid crystal display device.

It is therefore necessary to reduce the power consumption of the D/A converters 104 and the buffers 105 in order to efficiently achieve low power consumption of the overall liquid crystal driving circuit.

In one known mechanism, the operations of the buffers 105 and the D/A converters 104, which require high power consumption; are turned on or off by a source driver according to an external signal (see Japanese Unexamined Patent Application Publication No. 2001-188499). The structure of such a source driver will be described with reference to FIG. 6.

A control signal to provide low power consumption is input to a buffer 106, an inverter circuit 108, and a switch 107 in a standby mode.

In the standby mode, the power supply to the buffer 106 is turned off and the power supply to the inverter circuit 108 is turned on, so that a signal from the inverter circuit 108 is output from the switch 107.

In a non-standby mode, the power supply to the buffer 106 is turned on and the power supply to the inverter circuit 108 is turned off, so that a signal from the buffer 106 (analog grayscale data generated by the D/A converter 109, corresponding to a certain number of gray levels) is output from the switch 107.

Therefore, the operation of the buffer 106 is controlled, thus realizing low power consumption.

However, this structure allows for only chip-based batch control of the output modes of the source driver because of standby-mode control.

In this structure, the most significant bit (MSB) of the input digital grayscale data is output to the inverter circuit 108 in the standby mode so as to output binary data.

Thus, only eight colors are represented by using one-bit (the most significant bit) grayscale data for each of R (red), G (green), and B (blue); whereas, 260,000 colors are represented by using 6-bit grayscale data for each of R, G, and B. The above-described structure provides fewer displayable colors, resulting in degradation in image quality.

It is therefore difficult to provide low power consumption for a normal display without reducing the number of displayable colors and the image quality. Accordingly, what is needed is an improved liquid crystal driving circuit providing low power consumption while maintaining the number of gray levels for the image.

SUMMARY OF THE INVENTION

Accordingly, it is an object of the present invention to provide a liquid crystal driving circuit which achieves low power consumption without reducing the number of gray levels and degrading the image quality.

In one aspect, the present invention provides a signal processing circuit including a D/A conversion circuit for converting input digital data into an analog voltage and outputting the converted analog voltage, a first switch for selecting one of a plurality of supplied voltages and outputting the selected voltage as a supply analog voltage, a second switch for selecting one of the converted analog voltage and the supply analog voltage and outputting the selected voltage as an analog voltage, and a detection circuit for determining whether or not the input digital data matches internal set data, and, when it is determined that the input digital data matches the set data, switching the first switch so that the supply analog voltage corresponding to the input digital data is output and switching the second switch so that the supply analog voltage is output.

Thus, when the detection circuit determines that the input digital grayscale data matches certain set data, the detection circuit turns off the power supply to the D/A conversion circuit having a D/A converter and a buffer, and changes the output modes of the first and second switches so that one of the input different voltages is selected, that is, so that the voltage corresponding to the input digital grayscale data is selected from the plurality of voltages input to the first switch and the selected voltage is output as an analog-grayscale-voltage driving signal. Therefore, when the signal processing circuit of the present invention is used for D/A conversion in a liquid crystal display device, the power consumption can be greatly reduced in a source driver, thus realizing a low-consumption-power device.

In a signal processing circuit in accordance with embodiments of the present invention, the detection circuit may have digital data corresponding to the supply analog voltage as the set data, and the correspondence between the set digital data and the supply analog voltage may be similar to the correspondence between the input digital and the converted analog voltage in the D/A conversion circuit.

Thus, a voltage having a similar value to the converted voltage output from the D/A conversion circuit can be supplied via the first and second switches. This allows for conversion of the digital grayscale data into the corresponding analog-grayscale-voltage driving signal without using the D/A conversion circuit. Since the D/A conversion circuit is not used to convert digital grayscale data into a specific voltage, the power consumption is reduced.

Moreover, in the signal processing circuit of the present invention, input digital grayscale data is checked for each column line to determine, for each column line, which of the converted signal (converted analog voltage) from the D/A conversion circuit and the supply signal (supply analog voltage) from the first switch is to be output as an analog-grayscale-voltage driving signal. When it is determined that the digital grayscale data indicates an intermediate gray level, the output signal from the D/A conversion circuit is output as analog grayscale data. Thus, the number of gray levels is not reduced. Therefore, the power consumption can be reduced without degradation in image quality.

In a signal processing circuit in accordance with embodiments of the present invention, when the detection circuit determines that the input digital data matches the internal set data, a power supply to the D/A conversion circuit having a D/A converter and a buffer can be turned off.

Thus, a power supply to the D/A conversion circuit having a D/A converter and a buffer can be controlled, if necessary, thus reducing unnecessary power and reducing the power consumption.

In a signal processing circuit in accordance with embodiments of the present invention, the first switch can select one of a power supply voltage supplied from a power supply circuit and 0 V (ground voltage) by switching, and can output the selected voltage as the supply analog voltage.

Thus, the power supply to the D/A conversion circuit is turned off when a power supply voltage and a ground voltage, which require high power consumption of the D/A conversion circuit, are output, and the output modes of the first and second switches are changed so that an analog grayscale voltage of a driving signal can be obtained from a power supply unit. Since the D/A conversion circuit is not used during this operation, low power consumption can be realized.

In a signal processing circuit in accordance with embodiments of the present invention, the first switch can select a predetermined voltage in a range between a power supply voltage supplied from a power supply circuit and 0 V by switching, and can output the selected voltage as the supply analog voltage.

An analog grayscale voltage corresponding to the most frequently used gray level or analog grayscale voltages corresponding to a plurality of frequently used gray levels can be supplied from the first switch, thus allowing more accurate control of the operations of the D/A converter and the buffer. Therefore, low power consumption can be realized also in this situation.

A signal processing circuit in accordance with embodiments of the present invention may further include a counter for counting each piece of input digital data in units of predetermined ranges, and a power supply generation circuit for generating a voltage corresponding to the set data and supplying the generated voltage to the first switch, wherein the detection circuit may select a piece of or a plurality of pieces of digital data having a high input count from the digital data as a result of counting and may set the selected piece or pieces of digital data as the set data in units of the predetermined ranges.

Thus, the most frequently used gray level is detected during actual usage, and is set as the set data in addition to the gray levels corresponding to the power supply voltage and the ground voltage so as to supply the corresponding analog grayscale voltage from the first switch. This allows more real-time control of the operations of the D/A converter and the buffer. Low power consumption can thereby be realized.

In another aspect, the present invention provides a liquid crystal driving circuit using the above-described signal processing circuit as a driving voltage generation circuit for supplying an analog voltage corresponding to input digital grayscale data to each of a plurality of signal lines.

Because of the aforementioned advantages of the driving voltage generation circuit, the liquid crystal driving circuit of the embodiments of the present invention can achieve significantly reduced power consumption levels.

DESCRIPTION OF THE PREFERRED EMBODIMENTS

The structure of a source driver according to an embodiment of the present invention will be described with reference to the drawings.

First Embodiment

Figure 1:
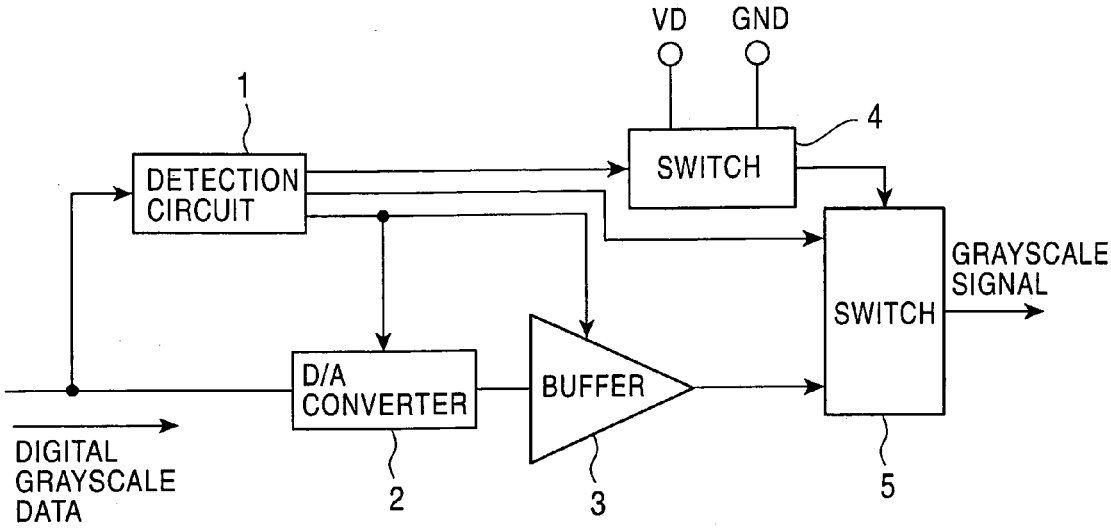
FIG. 1 is a block diagram of a driving voltage generation circuit according to a first embodiment of the present invention.

FIG. 1 is a concept diagram of a driving voltage generation circuit according to a first embodiment of the present invention.

Figure 4:
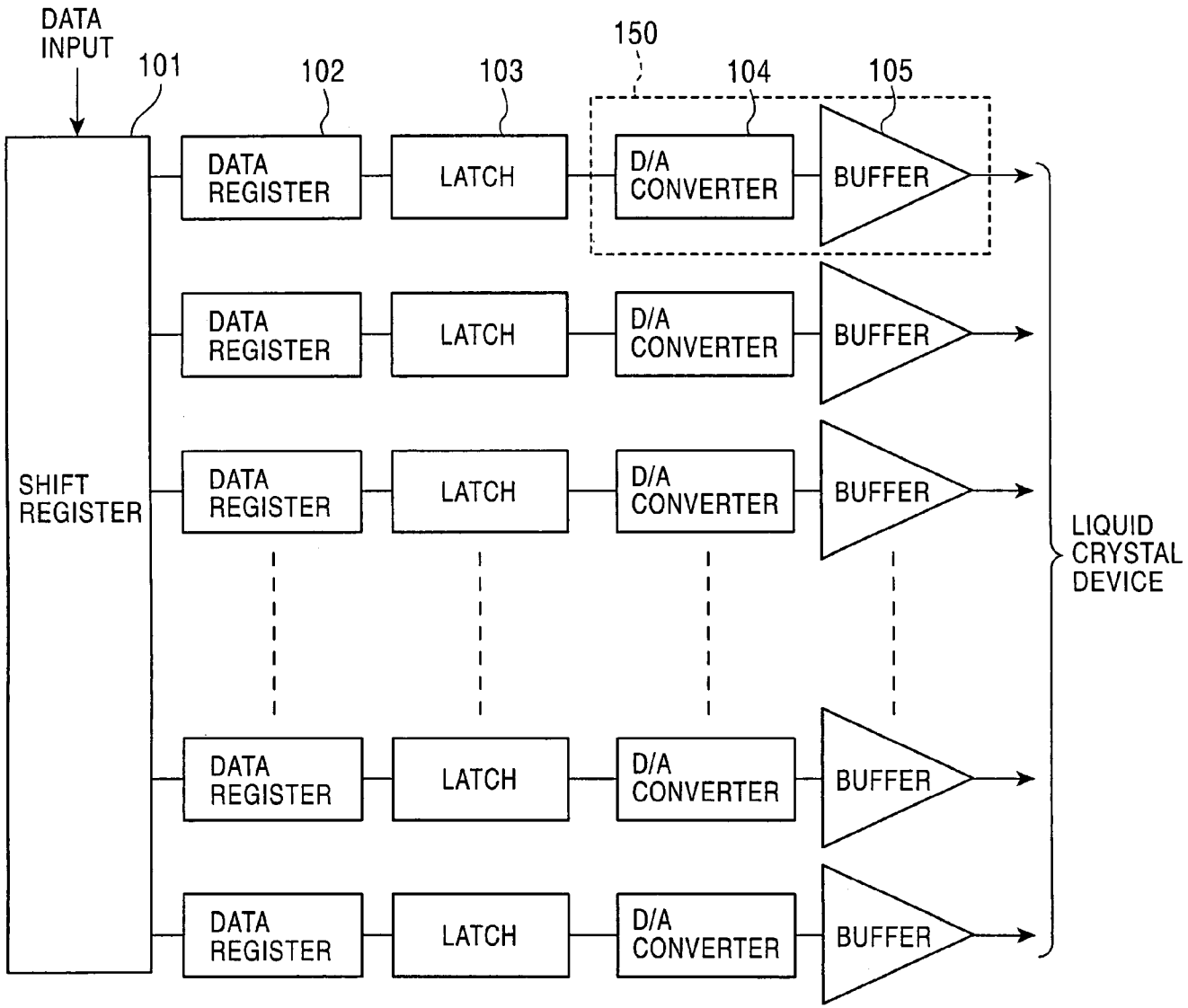
FIG. 4 is a block diagram of a source driver in a liquid crystal display device.
Figure 5:
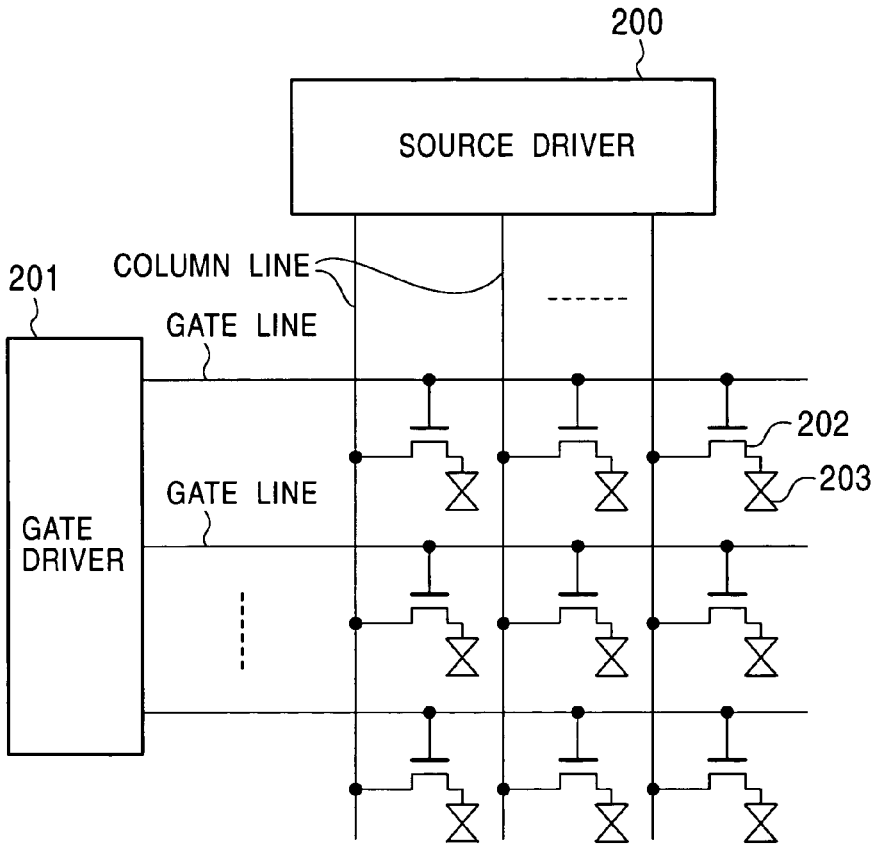
FIG. 5 is a concept diagram of the liquid crystal display device.
Figure 6:
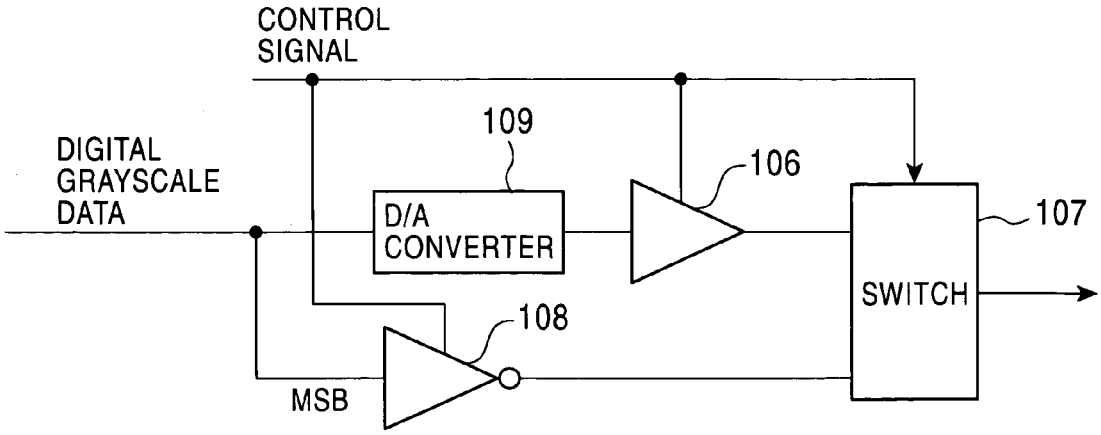
FIG. 6 is a block diagram of a driving voltage generation circuit of the related art.

A source driver according to embodiments of the present invention is similar to the source driver 200 used in the liquid crystal display device shown in FIG. 5 having the structure shown in FIG. 4, whereas a driving voltage generation circuit 150 has the structure shown in FIG. 1.

The driving voltage generation circuit shown in FIG. 1 includes at least a detection circuit 1, a D/A converter 2, a buffer 3, and switches 4 and 5.

The detection circuit 1 determines whether or not digital grayscale data input from a latch (not shown), e.g., the latch 103 shown in FIG. 4, matches internal set data that is set in advance.

Assuming that digital grayscale data to be converted into an analog grayscale voltage is 6-bit data, the set data is, for example, digital grayscale data indicating gray levels 63 and 0, which require higher power consumption than the remaining gray levels.

The D/A converter 2 converts the input digital grayscale data into an analog voltage signal based on a predetermined correspondence between digital grayscale data and analog voltages, and outputs the converted analog voltage signal.

This correspondence between the input digital grayscale data and analog voltage based on the D/A converter 2 is similar to a correspondence between the set data of the detection circuit 1 and the corresponding supply analog voltage to be transmitted from the output terminal of switch 4.

The detection circuit 1 controls a power supply to operate the D/A converter 2.

The buffer 3 amplifies the converted signal output from the D/A converter 2, and supplies the sufficiently-power-amplified driving signal to each column line, to which a source of a transistor is connected, via the transistor to drive a liquid crystal device.

The detection circuit 1 also controls a power supply to the buffer 3 for power amplification.

When the buffer 3 amplifies converted analog voltage signals for gray levels 63 and 0, the buffer 3 must drive a plurality of internal transistors. Thus, higher power is required for gray levels 63 and 0 than the remaining gray levels.

The switch 4 has input terminals to which predetermined voltages, that is, a power supply voltage VD and a ground voltage GND, are input. The switching control of the switch 4 is performed by the detection circuit 1 so that either voltage is to be supplied to the switch 5 as a supply analog voltage.

The switch 5 receives the supply signal (supply analog voltage) output from the switch 4 and the converted signal (converted analog voltage) output from the buffer 3. The switching control of the switch 5 is also performed by the detection circuit 1 so that either signal is to be output as an analog-grayscale-voltage driving signal to drive a liquid crystal device.

The operation of the liquid crystal display device in accordance with the first embodiment will be described with reference to FIGS. 1, 4, and 5.

For simplicity of description, 6-bit digital grayscale data (for the grayscale range between gray level 0 and gray level 63) is employed.

When the digital grayscale data indicates gray level "63" (white in grayscale), represented by "1 (MSB) 11111 (LSB); 3F (hexadecimal)", the D/A converter 2 outputs the converted signal of the power supply voltage VD as the converted analog voltage. When the digital grayscale data indicates gray level "0" (black in grayscale), represented by "000000;00", the D/A converter 2 transmits as an output signal (i.e., outputs) the converted signal of the ground voltage GND as the converted analog voltage.

When digital grayscale data for any of the grayscale range of gray levels 62 through 1 is input, the D/A converter 2 transmits as an output signal, as an intermediate-gray-level converted analog voltage, the converted signal of the converted analog voltage, between the power supply voltage VD and the ground voltage GND, corresponding to the digital grayscale voltage based on a predetermined correspondence.

In this case, the set data in the detection circuit 1 is data for gray levels "3F" and "00", which require higher power consumption of the D/A converter 2 and the driver 3 than the remaining gray levels.

When digital grayscale data is transmitted from the data register 102 to the input of latch 103, the latch 103 holds the digital grayscale data, and supplies the digital grayscale data to the detection circuit 1 and the D/A converter 2.

The detection circuit 1 determines whether or not the digital grayscale data received at the input terminal matches any of the internal set data "3F" and "00" by comparing these data.

When the detection circuit 1 determines that the digital grayscale data received at the input terminal does not match "3F" or "00", the detection circuit 1 controls the switch 5 so that the converted signal from the buffer 3 is transmitted to each column line as a driving signal.

When the detection circuit 1 determines that the digital grayscale data received at the input terminal matches the set data "3F" or "00", the detection circuit 1 turns off the power supply to the D/A converter 2 and the buffer 3 (or the power supply to the buffer 3).

The detection circuit 1 also controls the switch 4 so that the supply analog voltage corresponding to the digital grayscale data received at the input terminal of the detection circuit is transmitted as an output signal.

For example, when it is determined that the input digital grayscale data (i.e., received at the input terminal) is "3F", the supply signal of the supply analog voltage (power supply voltage) VD is supplied from the switch 4.

Accordingly, when the input digital grayscale data is "3F", the detection circuit 1 controls the switch 4 so as to transmit a supply signal of a supply analog voltage of the power supply voltage VD; when the input digital grayscale data is "00", the detection circuit 1 controls the switch 4 so as to transmit as output a supply signal of a supply analog voltage of the ground voltage GND.

The detection circuit 1 further controls the switch 5 so that any of the supply signals is supplied.

This switching control allows the supply signal from the switch 4 to be supplied from the switch 5 to each column line as a driving signal.

As described above, in the liquid crystal driving circuit according to the first embodiment, the detection circuit 1 turns off the power supply to the D/A converter 2 and the buffer 3 when the detection circuit 1 determines that the input digital grayscale data matches the set data "3F" or "00", and further changes the output modes of the switches 4 and 5 so that the supply signal of the analog grayscale voltage corresponding to the power supply voltage VD or the ground voltage GND is transmitted as the output signal. Therefore, low power consumption can be realized.

The power consumption of the D/A converter 2 and the buffer 3 occupies 70% to 80% of the overall power consumption of the source driver 200. Turning off the power supply to the D/A converter 2 and the buffer 3 contributes to significantly reduce power consumption.

The liquid crystal driving circuit according to the first embodiment is often used to drive liquid crystal devices of a portable device for providing character data display, etc., by switching the switches 4 and 5. The advantage of low power consumption is useful particularly for such applications.

In the liquid crystal driving circuit according to the first embodiment, it is determined, for each of the column lines shown in FIG. 4, whether or not input digital grayscale data matches "3F" or "00", and it is determined, for each column line, which of the converted signal (converted analog voltage) from the buffer 3 and the supply signal (supply analog voltage) is to be output as an analog-grayscale-voltage driving signal. When it is determined that the digital grayscale data indicates an intermediate gray level, the output signal from the D/A converter 2 and the buffer 3 is output as analog grayscale data. Thus, the number of gray levels is not reduced. Therefore, low power consumption can be realized without degradation in image quality.

Second Embodiment

Figure 2:
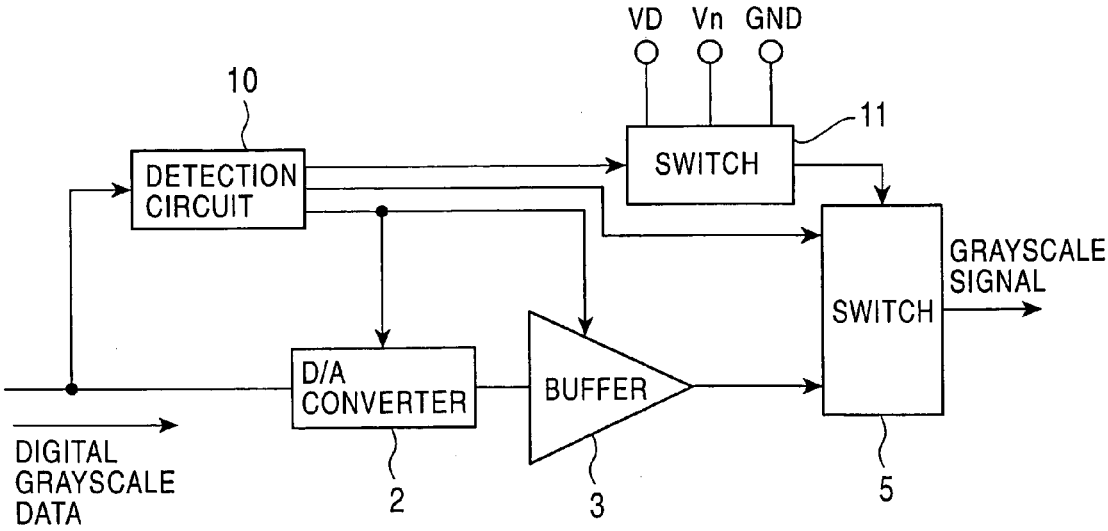
FIG. 2 is a block diagram of a driving voltage generation circuit according to a second embodiment of the present invention.

FIG. 2 is a concept diagram of a driving voltage generation circuit according to a second embodiment of the present invention.

In the driving voltage generation circuit shown in FIG. 2, similar elements to those shown in FIG. 1 are given the same reference numerals, and a description thereof is omitted.

The difference from the driving voltage generation circuit of the first embodiment is that a switch 11 further receives an intermediate voltage Vn similar to an analog grayscale voltage corresponding to, for example, a frequently used gray level, in addition to the predetermined voltages input to the switch 4 shown in FIG. 1, i.e., the power supply voltage VD and the ground voltage GND.

In accordance with the structure of the switch 11, the digital grayscale data corresponding to the power supply voltage VD, the ground voltage GND, and the intermediate voltage Vn, represented by "3F", "00", and "NN (any gray level value)", respectively, are set as the set data of a detection circuit 10.

The detection circuit 10 determines whether or not the input digital grayscale data, i.e., that received at the input terminal, matches any of the set data "3F", "00", and "NN".

When it is determined that the input digital grayscale data matches any of the set data, the detection circuit 10 controls the switch 11 so that a supply signal of a supply analog voltage having a similar voltage value to the analog grayscale voltage corresponding to the matched set data is supplied, and also controls the switch 5 so that the supply signal from the switch 11 is transmitted from the output terminal as a grayscale signal.

The structure and operation of the remaining components are similar to those of the driving voltage generation circuit of the first embodiment.

According to the second embodiment, therefore, in addition to the advantages of the first embodiment, an analog grayscale voltage corresponding to the most frequently used gray level or analog grayscale voltages corresponding to a plurality of frequently used gray levels can be supplied from the switch 11, thus allowing more accurate control of the operations of the D/A converter 2 and the buffer 3. Therefore, low power consumption can be realized.

Third Embodiment

Figure 3:
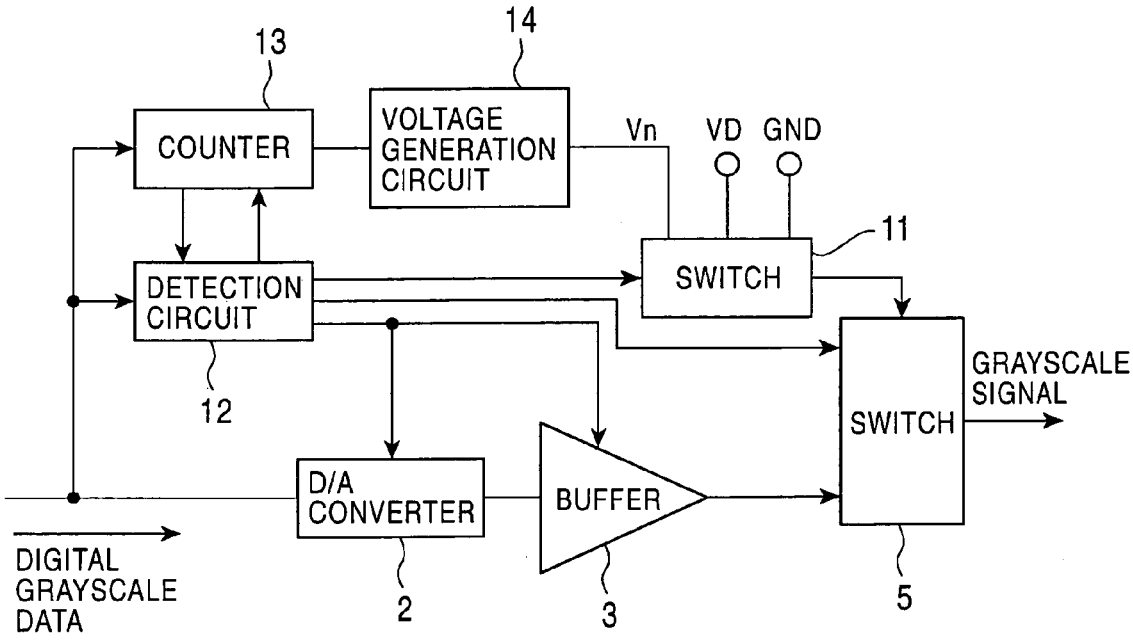
FIG. 3 is a block diagram of a driving voltage generation circuit according to a third embodiment of the present invention.

FIG. 3 is a concept diagram of a driving voltage generation circuit according to a third embodiment of the present invention.

In the driving voltage generation circuit shown in FIG. 3, similar elements to those shown in FIG. 2 are given the same reference numerals, and a description thereof is omitted.

The difference from the driving voltage generation circuit of the second embodiment is that the driving voltage generation circuit of the third embodiment shown in FIG. 3 further includes a power supply generation circuit 14 for generating an intermediate voltage equivalent to an analog grayscale voltage corresponding to a frequently used gray level to be supplied to the switch 11.

The driving voltage generation circuit of the third embodiment further includes a counter 13. Each time a pixel is input, the counter 13 counts each of the gray levels to be used in the input pixel, for example, 64 gray levels that ranges from "63" to "00", and outputs the gray level having the highest input count to a detection circuit 12 and the power supply generation circuit 14.

Alternatively, the counter 13 may select a plurality of gray levels having a high input count, and may output the selected gray levels to the detection circuit 12 and the power supply generation circuit 14.

The detection circuit 12 outputs control signals indicating count start and count end to the counter 13 so that the counter 13 can count input pixels per screen.

In response to the count-start control signal, the counter 13 starts to count a pixel. In response to the count-end control signal, the counter 13 outputs the selected gray level to the detection circuit 12 and the power supply generation circuit 14.

The power supply generation circuit 14 generates a voltage Vn corresponding to the gray level (digital grayscale data) input from the counter 13, and outputs the voltage Vn to the switch 11.

The detection circuit 12 captures, as digital grayscale data for a frequently used intermediate grayscale, the gray level output from the counter 13 in response to the count-end control signal output from the detection circuit 12, so that the captured gray level is further set as the set data in addition to the gray levels "63" and "00".

When it is determined that the input digital grayscale data matches any of the set data, the detection circuit 12 controls the switch 11 so that a supply signal of a supply analog voltage having a similar voltage value to the analog grayscale voltage corresponding to the matched set data is supplied, and also controls the switch 5 so that the supply signal from the switch 11 is output as a grayscale signal.

The structure and operation of the remaining components are similar to those of the driving voltage generation circuit of the second embodiment.

According to the third embodiment, therefore, in addition to the advantages of the first and second embodiments, the most frequently used gray level is detected during actual usage, and is set as the set data in addition to the gray levels "63" and "00" so as to supply the corresponding analog grayscale voltage from the switch 11. This allows more real-time control of the operations of the D/A converter 2 and the buffer 3. Low power consumption can also be realized.

Some embodiments of the present invention have been described in detail with reference to the drawings; however, these embodiments are merely examples. The specific structure is not limited to the structure shown in such embodiments, and a variety of modifications may be made to the present invention without departing from the scope and spirit of the invention.

Currently, general-purpose liquid crystal driver ICs (integrated circuits) designed for portable usage allow switch-output-mode driving (for example, eight-color) or amp-output-mode driving (for example, 260,000-color) to be selected by a mode specification signal.

According to one of the applications of the present invention, therefore, a detection circuit outputs a mode specification signal for selecting the switch output mode if digital grayscale data input in units of scanning lines or frames has the same bit level (either all 1's or all 0's), and, otherwise, outputs a mode specification signal for selecting the amp output mode.

This enables power consumption control of liquid crystal devices in each driver output area, and the power consumption can therefore be reduced in a driving circuit.

What is claimed is:

1. A signal processing circuit comprising:

a D/A conversion circuit for converting input digital data into an analog voltage and outputting the converted analog voltage;

a first switch for selecting one of a plurality of supplied voltages and outputting the selected voltage as a supply analog voltage;

a second switch for selecting one of the converted analog voltage and the supply analog voltage and outputting the selected voltage as an analog voltage; and a detection circuit for determining whether or not the input digital data matches internal set data, and, when it is determined that the input digital data matches the set data, switching the first switch so that the supply analog voltage corresponding to the input digital data is output and switching the second switch so that the supply analog voltage is output.

2. A signal processing circuit according to claim 1, wherein the detection circuit has digital data corresponding to the supply analog voltage as the set data; and the correspondence between the set digital data and the supply analog voltage is similar to the correspondence between the input digital and the converted analog voltage in the D/A conversion circuit.

3. A signal processing circuit according to claim 2, further comprising:

a counter for counting each piece of input digital data in units of predetermined ranges; and a power supply generation circuit for generating a voltage corresponding to the set data and supplying the generated voltage to the first switch, wherein the detection circuit selects a piece of or a plurality of pieces of digital data having a high input count from the digital data as a result of counting, and sets the selected piece or pieces of digital data as the set data in units of the predetermined ranges.

4. A signal processing circuit according to claim 1, wherein a power supply to the D/A conversion circuit is turned off when the detection circuit determines that the input digital data matches the internal set data, the D/A conversion circuit being formed of a D/A converter and a buffer.

5. A signal processing circuit according to claim 1, wherein the first switch selects one of a power supply voltage supplied from a power supply circuit and 0 V by switching, and outputs the selected voltage as the supply analog voltage.

6. A signal processing circuit according to claim 1, wherein the first switch selects a predetermined voltage in a range between a power supply voltage supplied from a power supply circuit and 0 V by switching, and outputs the selected voltage as the supply analog voltage.

7. A liquid crystal driving circuit using the signal processing circuit according to claim 1 as a driving voltage generation circuit for supplying an analog voltage corresponding to input digital grayscale data to each of a plurality of signal lines.

8. A signal processing circuit configured to:

receive digital data;

convert the received data to a converted analog voltage;

supply a plurality of supplied voltages to a switch circuit configured to select one of the plurality as a supply analog voltage;

determining whether the received digital data matches stored set data; and when the match occurs configuring the switch circuit such that the supply analog voltage matching the received analog voltage is output.

9. The signal processing circuit as recited in claim 8 wherein the switch circuit comprises a first and second switch, the first switch configured to select one of the plurality of supplied voltages as the supply analog voltage and the second switch configured to select one of the converted analog voltage and the supply analog voltage and to transmit the selected voltage as an analog voltage from an output terminal of the signal processing circuit.

10. The signal processing circuit as recited in claim 9 wherein the first switch selects a predetermined voltage in a range between a power supply voltage supplied from a power supply circuit and 0 V by switching, and outputs the selected voltage as the supply analog voltage.

11. The signal processing circuit as recited in claim 9 wherein the signal processing circuit is further configured to determine the distribution of input digital data in units of predetermined ranges and selecting the input digital data having a frequency of occurrence exceeding a threshold to the stored set data, wherein the signal processing circuit further comprises a power supply generation circuit for generating a voltage corresponding to the set data and supplying the generated voltage to the first switch.

12. The signal processing circuit as recited in claim 8 wherein a power supply causing the circuit to convert the received data to a converted analog voltage is turned off when the detection circuit determines that the input digital data matches the internal set data.

* * * * *